US008605932B2

(12) United States Patent
Semcken

(10) Patent No.: US 8,605,932 B2
(45) Date of Patent: Dec. 10, 2013

(54) SINGLE CHAMBER HEADPHONE APPARATUS

(75) Inventor: Kevin R. Semcken, Evergreen, CO (US)

(73) Assignee: Able Planet Incorporated, Wheat Ridge, CO (US)

( * ) Notice: Subject to any disclaimer, the term of this patent is extended or adjusted under 35 U.S.C. 154(b) by 670 days.

(21) Appl. No.: 12/746,916

(22) PCT Filed: Dec. 12, 2008

(86) PCT No.: PCT/US2008/086701
§ 371 (c)(1),
(2), (4) Date: Aug. 24, 2010

(87) PCT Pub. No.: WO2009/076649
PCT Pub. Date: Jun. 18, 2009

(65) Prior Publication Data

US 2010/0310093 A1 Dec. 9, 2010

Related U.S. Application Data

(60) Provisional application No. 61/012,974, filed on Dec. 12, 2007.

(51) Int. Cl.
*H04R 25/00* (2006.01)
*H04R 1/02* (2006.01)

(52) U.S. Cl.
USPC ..... 381/374; 381/332; 381/386; 381/390; 381/395

(58) Field of Classification Search
USPC ..... 381/374
See application file for complete search history.

(56) References Cited

U.S. PATENT DOCUMENTS

| | | | | |
|---|---|---|---|---|
| 3,751,608 | A * | 8/1973 | Weingartner | 381/372 |
| 4,005,267 | A * | 1/1977 | Gorike et al. | 381/62 |
| 4,156,118 | A | 5/1979 | Hargrave | |
| 4,365,114 | A | 12/1982 | Soma | |
| 4,455,675 | A | 6/1984 | Bose et al. | |
| 4,590,332 | A | 5/1986 | Delbuck | |
| 4,644,581 | A | 2/1987 | Sapiejewski | |
| 4,922,542 | A | 5/1990 | Sapiejewski | |
| 5,181,252 | A | 1/1993 | Sapiejewski et al. | |
| 5,185,807 | A | 2/1993 | Bergin et al. | |
| RE37,398 | E | 10/2001 | Nageno | |
| 6,597,792 | B1 | 7/2003 | Sapiejewski et al. | |
| 7,245,735 | B2 | 7/2007 | Han | |
| 7,340,071 | B2 | 3/2008 | Huang | |
| 7,412,070 | B2 | 8/2008 | Kleinschmidt et al. | |
| 2002/0094094 | A1 | 7/2002 | Shin | |
| 2005/0041831 | A1 | 2/2005 | Stiles et al. | |

(Continued)

OTHER PUBLICATIONS

International Preliminary Report on Patentability, Jun. 24.

(Continued)

*Primary Examiner* — Christopher Uhlir
(74) *Attorney, Agent, or Firm* — William J. Kubida; Peter J. Meza; Hogan Lovells US LLP

(57) ABSTRACT

A single chamber headphone apparatus and earcup design is provided which enhances wearer comfort, reduces headphone weight, facilitates ease of use, maintenance and operation by providing an improved internal chamber and battery cap configuration. Sound quality is improved by eliminating acoustic problems associated with two-chamber headset designs. A volume balance control is also provided.

10 Claims, 15 Drawing Sheets

(56) References Cited

U.S. PATENT DOCUMENTS

| | | | | |
|---|---|---|---|---|
| 2005/0058316 | A1* | 3/2005 | Yanagishita et al. | 381/371 |
| 2005/0213774 | A1* | 9/2005 | Kleinschmidt et al. | 381/71.6 |
| 2005/0238181 | A1 | 10/2005 | Nilsson et al. | |
| 2007/0092098 | A1* | 4/2007 | Kaderavek | 381/370 |
| 2008/0069391 | A1* | 3/2008 | Steyn et al. | 381/371 |
| 2008/0247588 | A1 | 10/2008 | Yang | |
| 2010/0310093 | A1 | 12/2010 | Semcken | |

OTHER PUBLICATIONS

PCT/US2008/086701 Written Opinion of the International Searching Authority, Date of Mailing Jul. 27, 2009, 5 pgs.

PCT/US2008/086701 (WO 2009/076649) International Search Report, Date of Mailing Jul. 27, 2009.

* cited by examiner

SINGLE CHAMBER HEADPHONE APPARATUS

PRIORITY TO RELATED APPLICATIONS

This application is the National Stage of International Application No. PCT/US08/86701 filed on Dec. 12, 2008, which claims the benefit of U.S. Provisional Application No. 61/012,974, filed Dec. 12, 2007, the entire contents of each which are incorporated herein by reference

FIELD OF THE INVENTION

The present invention relates to headphones or headsets generally, and, more particularly, to an improved headphone apparatus and earcup design which enhances wearer comfort, reduces headphone weight, facilitates ease of use, maintenance and operation by providing an improved internal chamber and battery cap configuration. The headphone apparatus of the present invention improves sound quality by eliminating acoustic problems associated with two-chamber headset designs. A volume balance control is also provided.

BACKGROUND OF THE INVENTION

Recent advances in sound transmission technology have lead to the development of new headphones or headsets for use in telecommunications and entertainment applications in both external environments, such as military field operations, and internal environments, such as home use for listening to music and/or radio and television broadcasts. Headsets normally include one or a pair of earcups which fit over the outer ear and which are held in place by hand or by means of a head band which extends over the top of or behind the wearer's head. In addition to sound quality, wearer comfort is of primary concern to the user, particularly if the headphones are to be worn over an extended time period.

Headphone designs intended to improve both headphone sound quality and wearer comfort are disclosed in U.S. Pat. No. 4,455,675 issued to Bose et al, Jun. 19, 1984 and in U.S. Pat. No. 4,644,581 issued to Sapiejewski, Feb. 17, 1987. The headphones which are the subject of those disclosures include headphone cavities and electroacoustical transducers such as pressure-sensitive microphones positioned within the cavities respectively for providing signals which correspond to the sum of external noise and the sound produced by the headphone driver in each cavity. These designs include internal circuitry which reduces noise and distortion and improves the quality of the sound output to the ear and a cushion in contact with the ear to enhance wearer comfort.

More recently, U.S. Pat. No. 4,922,542 issued to Sapiejewski, May 1, 1990 discloses a headphone in which each earcup includes a baffle which supports a driver for converting an electrical input signal into an acoustical output signal to the ear. The baffle defines an inner and an outer cavity, the outer cavity being positioned adjacent the wearers ear and encompassed by a cushion surrounding the outer ear and sealing the outer cavity from the surrounding external environment. Similarly, U.S. Pat. No. 5,181,252 issued to Sapiejewski et al., Jan. 19, 1993 discloses a headphone having a high compliance driver mounted on a baffle which divides the headphone earcup into two chambers, each chamber having a preselected compliance which is individually matched to the compliances of the other chamber and the driver respectively to maximize the quality of the acoustical output. U.S. Pat. No. 7,412,070 issued to Kleinschmidt at al., Aug. 12, 2008 discloses a headphone having a pair of earcups, each earcup having a loudspeaker driver located off-center in an internal cavity. However, the designs of the '542, the '252 and the '070 disclosures do not adequately address the problems associated with acoustic interference and cancellation phenomenon associated with multi-chamber headphone designs, nor do they address the problem of volume balance control.

The headphone design of the present invention overcomes these and other problems by providing a new and novel headphone design which eliminates the internal acoustical compliance-related issues associated with a multi-chamber headphone earcup construction and a volume balance control feature which will permit the wearer to selectively psychoacoustically calibrate, adjust and balance the sound volume in each earcup. More specifically, the present invention provides a single chamber earcup having the microphone and driver mounted inside the earcup in such a manner that the baffle is eliminated, thereby permitting free flow of air throughout the entire cavity formed by the back of the earcup and the side of the wearers head. Means are provided to support the driver and the microphone at a predetermined location within the earcup that is sufficiently removed from the wearer's outer ear to prevent damage to the microphone which could result from contact with the pinna and during the process of putting on and/or removing the headphones, yet which is sufficiently close to the ear canal to maximize the quality of the sound delivered to the eardrum. An improved battery cover or cap is also provided.

DESCRIPTION OF THE INVENTION

Before proceeding with the detailed description, it should be noted that the present teaching is by way of example, not by limitation. The concepts presented herein are not limited to use or application with one specific type of headphone or earcup design. Thus, although the instrumentalities described herein are for the convenience of illustration and explanation, shown and described with respect to exemplary embodiments, the principles disclosed herein may be applied to other types and applications of headphone and earcup apparatus.

Figure 1:
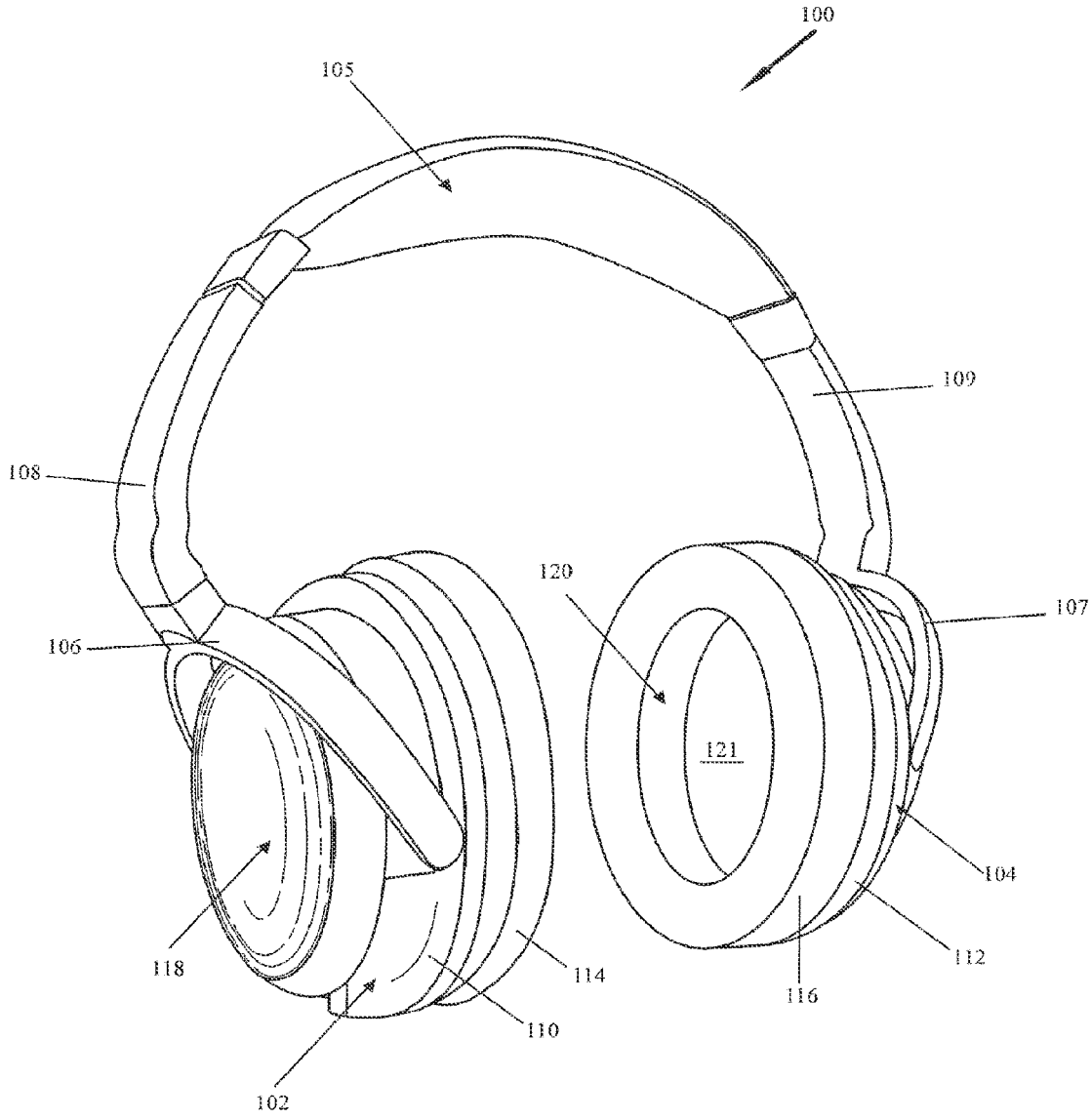
FIG. 1 is a perspective view of a headset according to an embodiment of the present invention.

Referring now to FIG. 1, a headphone or headset apparatus is illustrated in perspective and includes a pair of headphones (also known in the art as earphones) 102 and 104 adapted to fit over a users left and right outer ears (not shown). The earphones are pivotally connected to one another by an adjustable headband 105 adapted to fit over the top of a wearer's head, the headband having a wishbone-shaped yoke member 106, 107 secured at each end thereof for pivotally connecting the earphones to the headband. The headband comprises a pair of overlapping members 108, 109 which are slideably juxtaposed one on top of the other for adjustment to fit the wearer's head size. While in the embodiment shown, the headband is positioned over the top of the head, the headband alternatively could be of the behind-the-neck design without departing from the scope of the instant invention.

Each headphone includes an earcup 110, 112 pivotally mounted to the yoke members 106, 107 respectively, each earcup also having a cushion 114, 116 secured circumferentially thereto and adapted to fit over the wearer's left and right outer ears for comfort purposes, particularly during extended periods of wear. Earcup 110 also includes a battery cap 118 detachably secured thereto to contain one or more batteries in a battery compartment (not shown) formed in the earcup outer shell. The earcups each form an internal chamber, one of which is shown at 120, which is adapted to fit over the wearer's outer ear and which contains the electronics, circuitry, microphones, and at least one speaker, diaphragm and associated driving member for operation of the headset and the transformation of electrical signals into acoustical signals for transmission to the left and right inner ear canals of the wearer. Typically, a protective membrane or screen 121 is disposed over the microphone to keep dirt and other foreign matter from being deposited in the chamber, which could be deleterious to the operation of the headset.

Figure 2:
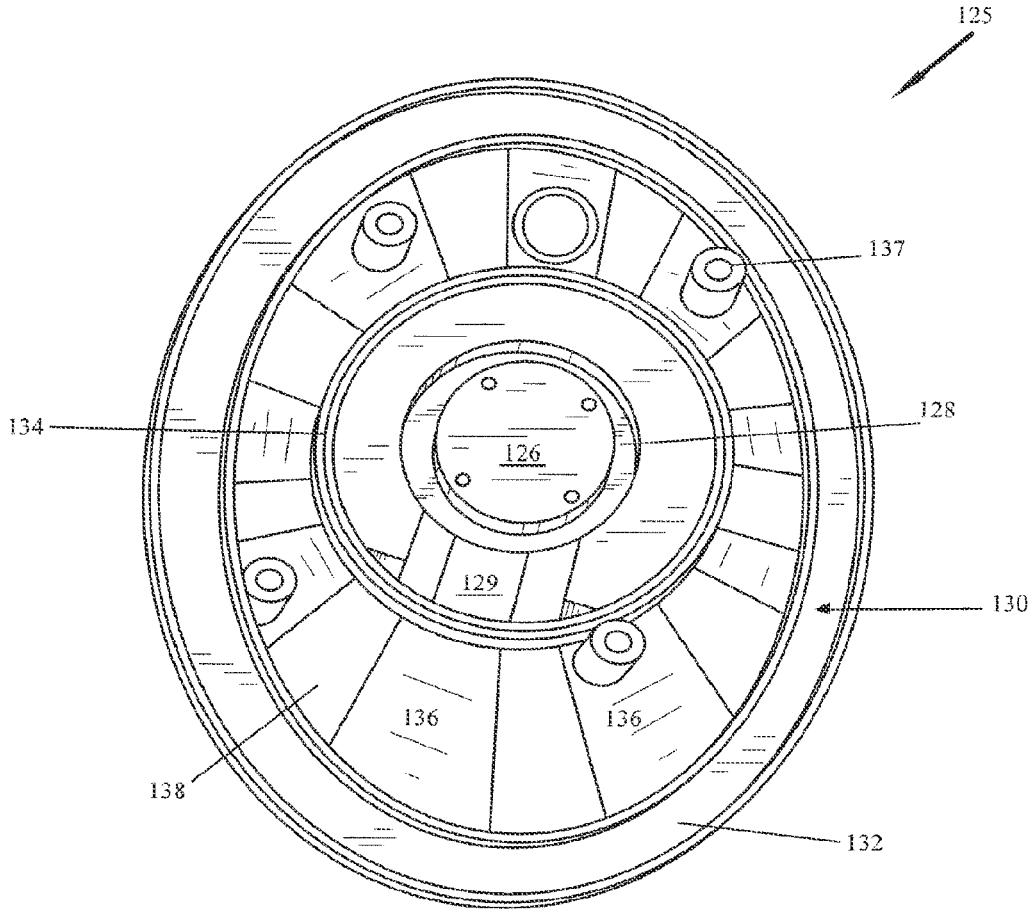
FIG. 2 is a perspective view of a microphone and driver mounting apparatus according to an embodiment.

A diaphragm and driver assembly 125 is illustrated generally in FIG. 2 in accordance with one embodiment of the instant invention. The assembly includes a diaphragm 126 coupled to a driver 128 and means for mounting the assembly in the internal chamber of the earcup. In the embodiment of FIG. 2, the driver is secured by arm 129 to a frame 130 for mounting inside an earcup 110, 112 of FIG. 1. The frame 130 includes a generally circumferentially-shaped outer annular portion 132 adapted to be fitted into the earcup 110, 112, an inner ring 134 to which the arm 129 and the driver assembly 125 are connected, and a plurality of spokes or arm members 136 disposed axially about the ring element and connected at a first end thereto. The spokes extend radially outwardly from the inner ring and are each connected at a second end to the outer annular portion 132 of the frame 130, the entire assembly being mounted inside the earcup. Bushings 137 are selectively formed on several of the spokes 136 and positioned circumferentially around the ring 134 for receiving mounting screws to secure protective cover over the diaphragm, as will hereinafter be discussed in greater detail.

The spaces 138 formed intermediate each spoke provide for the free flow of air and acoustic energy from the area in the chamber behind the diaphragm to the portion of the chamber positioned between the diaphragm and the outer ear. Hence, the acoustic problems associated having to match and balance the compliances of the speaker and of each of the inner and outer chambers formed by the baffles found in the prior art two-chamber headphones is eliminated, there being only a single chamber having a single compliance value in the exemplary headphone/earcup design of the present invention.

Figure 3:
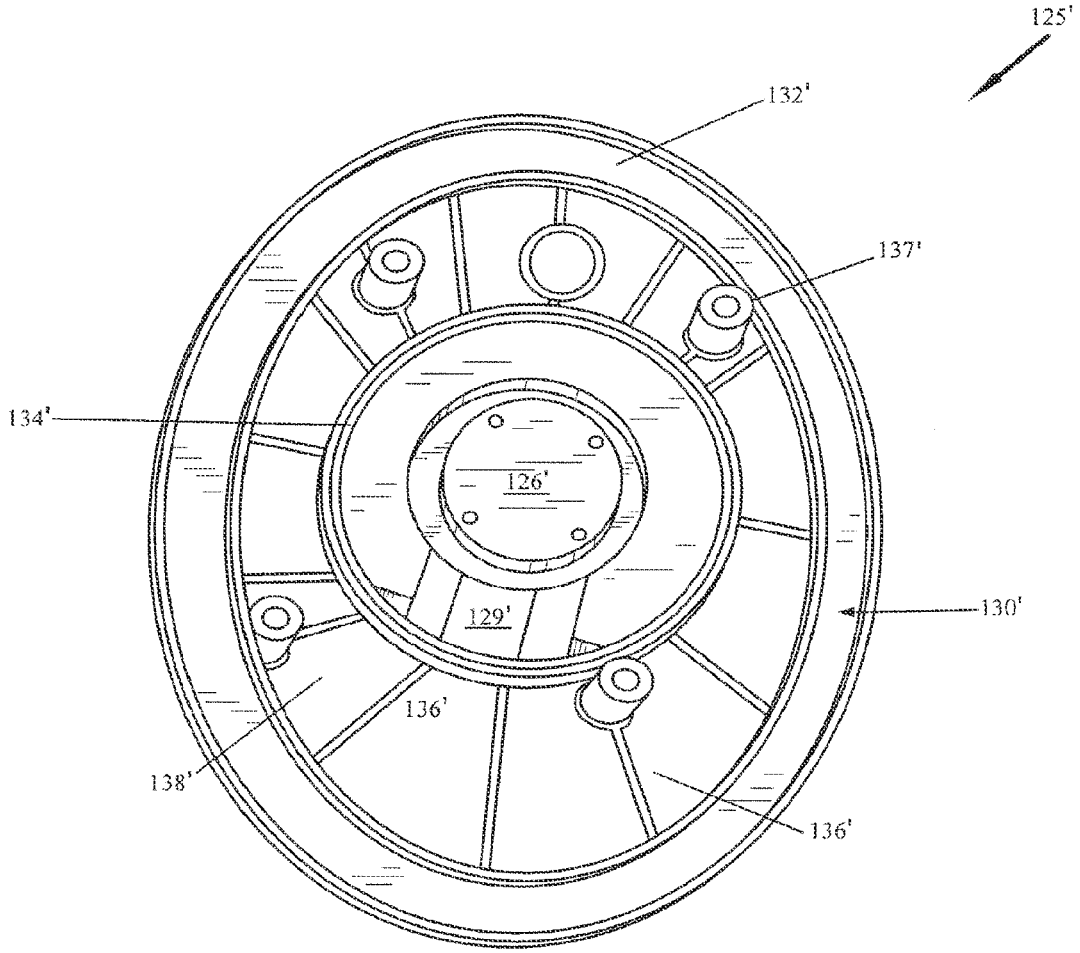
FIG. 3 is a perspective view of a microphone and driver mounting apparatus according to another embodiment.

In another embodiment of the present invention illustrated in FIG. 3, the assembly includes a diaphragm 126' mounted to a driver 128' which is secured by arm 129' to a frame 130' for mounting inside an earcup 110, 112 of FIG. 1. Similar in construction to the embodiment of FIG. 2, the frame 130 includes a generally circumferentially-shaped outer annular portion 132' adapted to be fitted into the earcup 110, 112, an inner ring 134' to which the arm 129' and the driver assembly 125' are connected, and a plurality of spokes or arm members 136' disposed axially about the ring element and connected at a first end thereto. In this embodiment, the spokes 136 are in the form of rigid, thin wires, much like bicycle spokes, which provide even greater spaces 138' intermediate each spoke, thus enhancing the single chamber effect.

Figure 4:
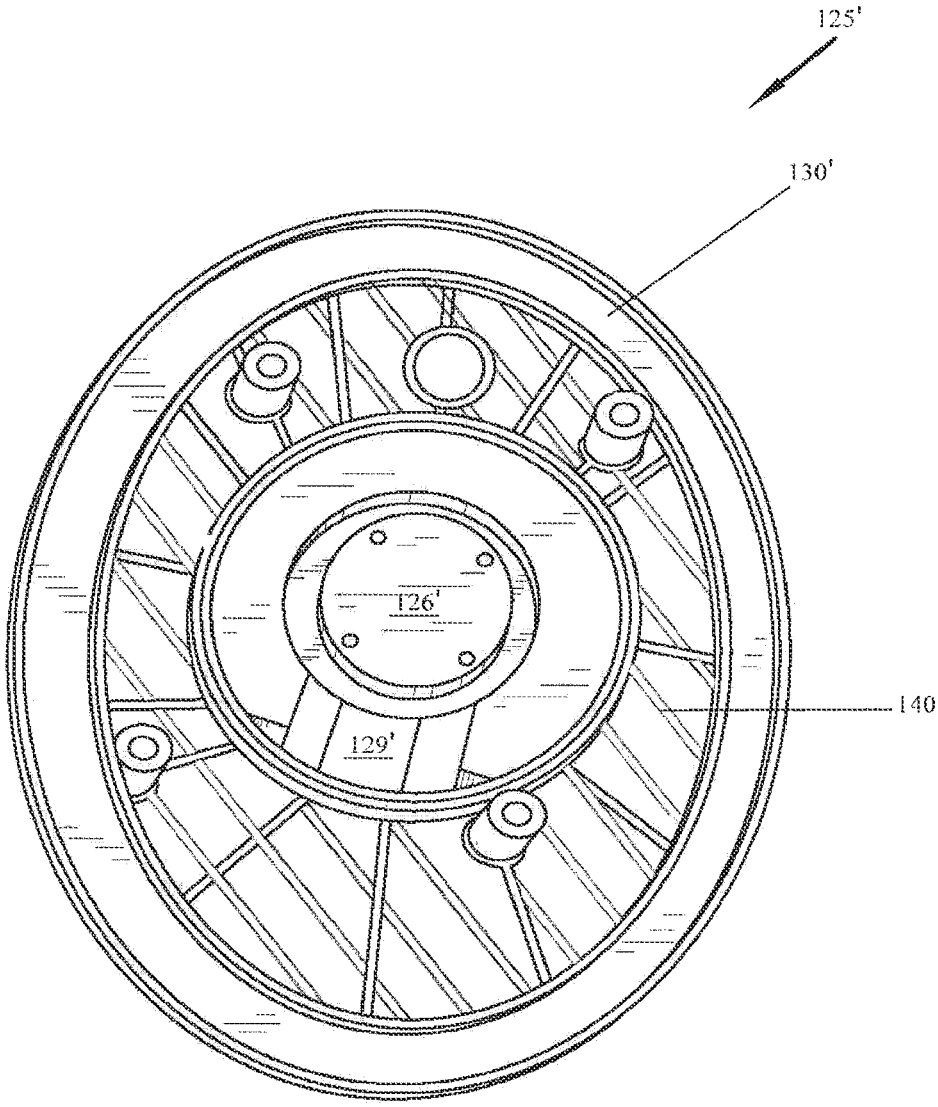
FIG. 4 is a perspective view of a microphone and driver mounting apparatus according to yet another embodiment.

FIG. 4 illustrates the embodiment of FIG. 3 further including supporting grid or framework 140 which is disposed immediately adjacent to and behind the frame 130' to provide additional structural support thereto. This additional support may be beneficial in holding the diaphragm 126' and frame 130 in position as the headphones are either placed upon or removed from a wearer's head.

Figure 5:
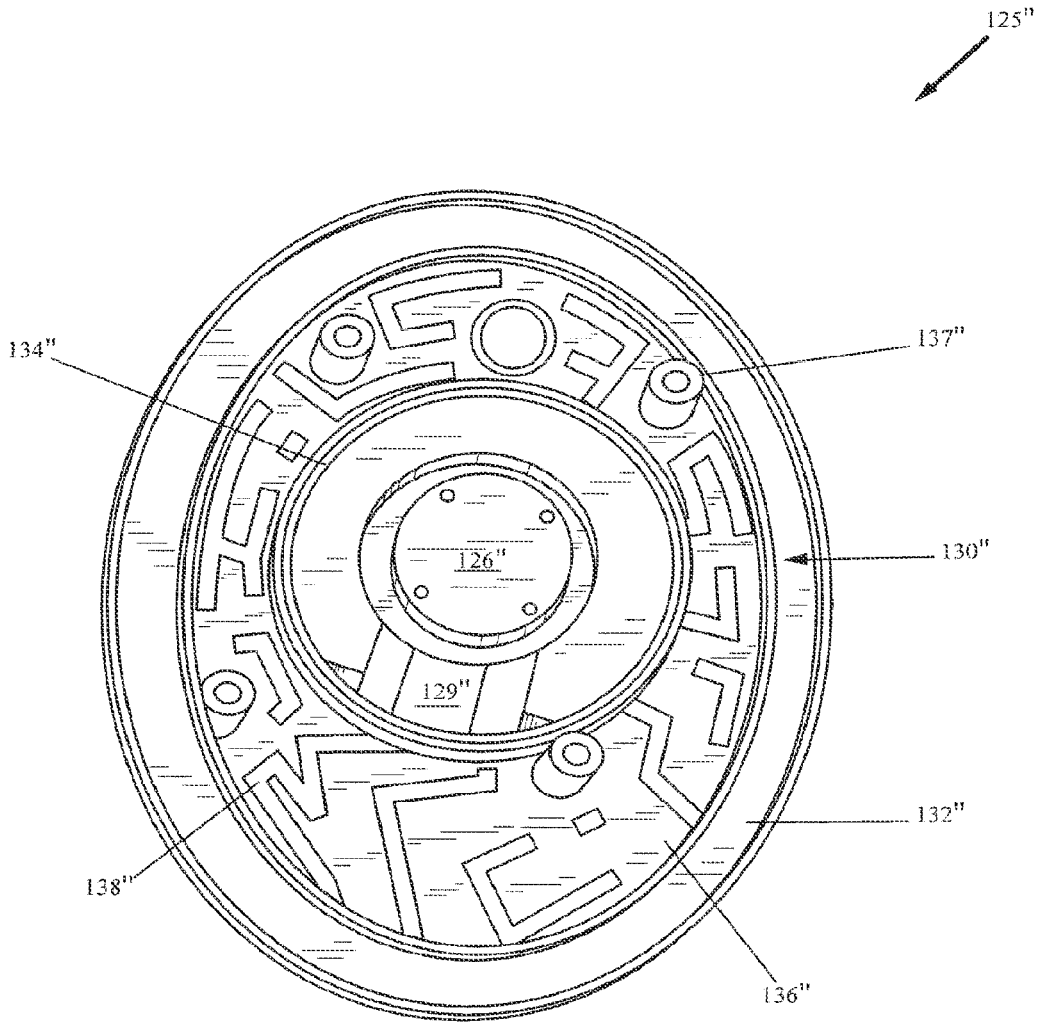
FIG. 5 is a perspective view of a microphone and driver mounting apparatus according to still another embodiment.

Yet another embodiment of the present invention is shown in FIG. 5 in which the frame 130" supporting the diaphragm or driver assembly 126" includes an outer annular ring 130" which is connected to an inner ring 134" by a maze structure 136". The maze structure contains irregularly shaped, spaced-apart slots 138" which eliminate the two chamber configuration of the prior art, provide additional support for the driver assembly 125" and further, collimate the air flow and sound or acoustic energy uniformly as it passes from the area behind the driver assembly to the listener's ear.

Figure 6:
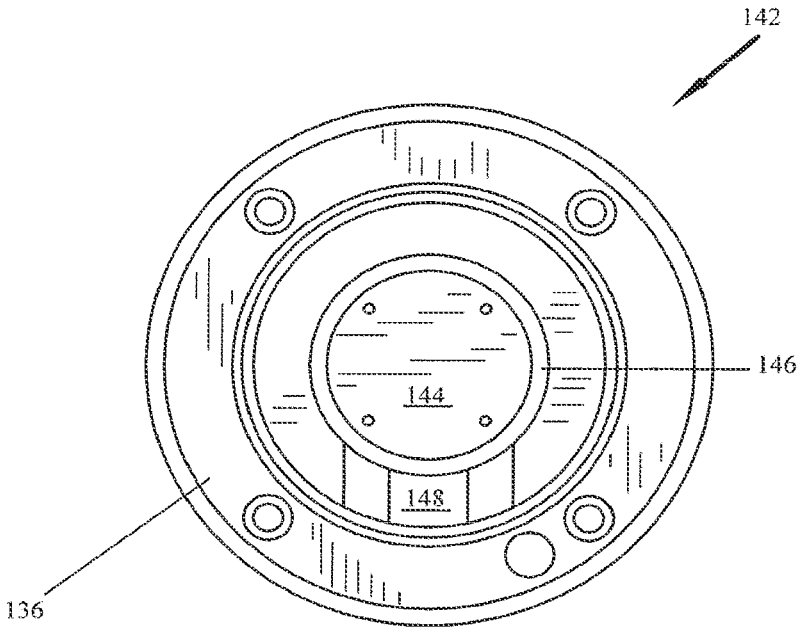
FIG. 6 is a plan view of a microphone and driver mounting apparatus according to another embodiment.

FIG. 6 depicts yet another embodiment of a diaphragm and driver assembly 142 in which the supporting frame 130, 130', 130" of the earlier embodiments is completely eliminated. In this embodiment, a diaphragm 144 and driver 146 are supported by arm 148 which is connected to a table assembly 150 mounted in the inner chamber of the earcup, as more clearly shown in FIG. 7.

Figure 7:
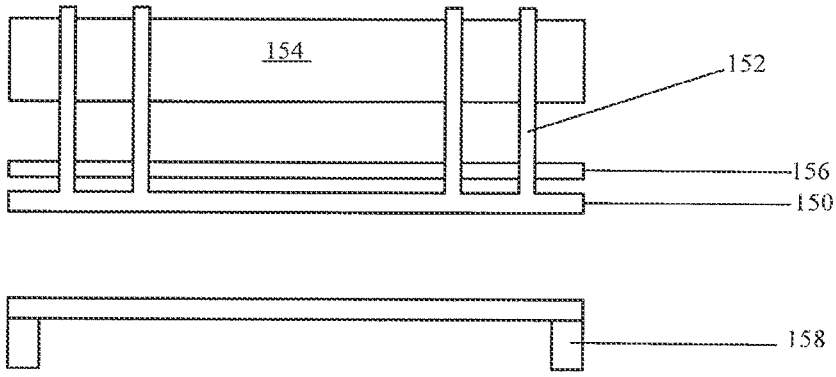
FIG. 7 is a side cross-sectional view of the microphone and driver mounting apparatus of the embodiment of FIG. 6.
Figure 8:
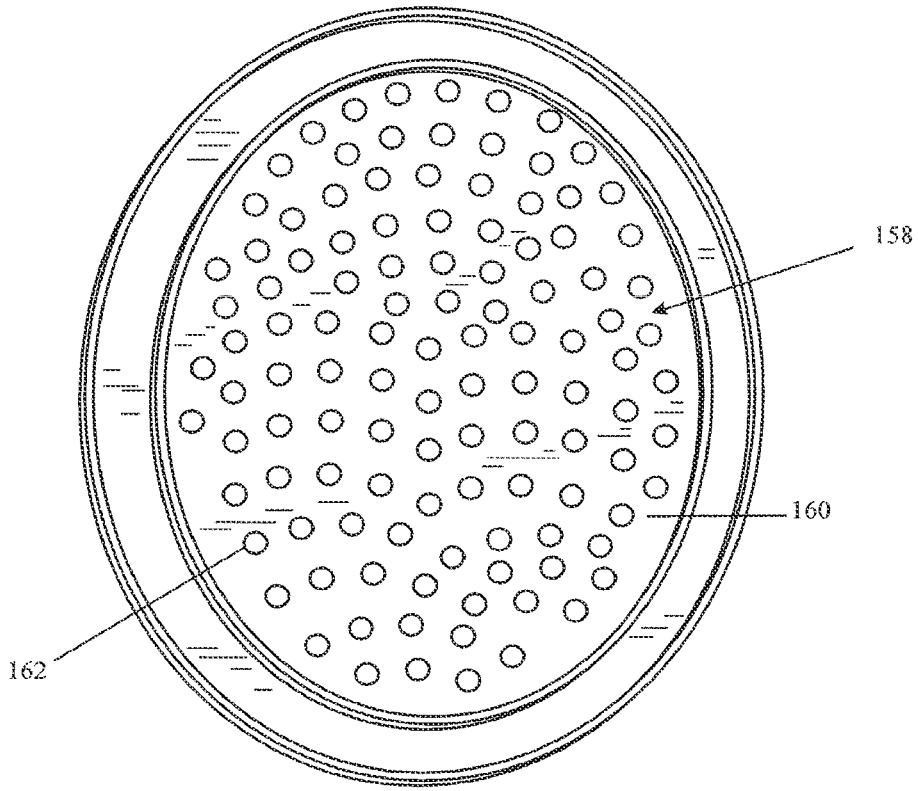
FIG. 8 is a perspective view of a free flow protective cover according to an embodiment.
Figure 9:
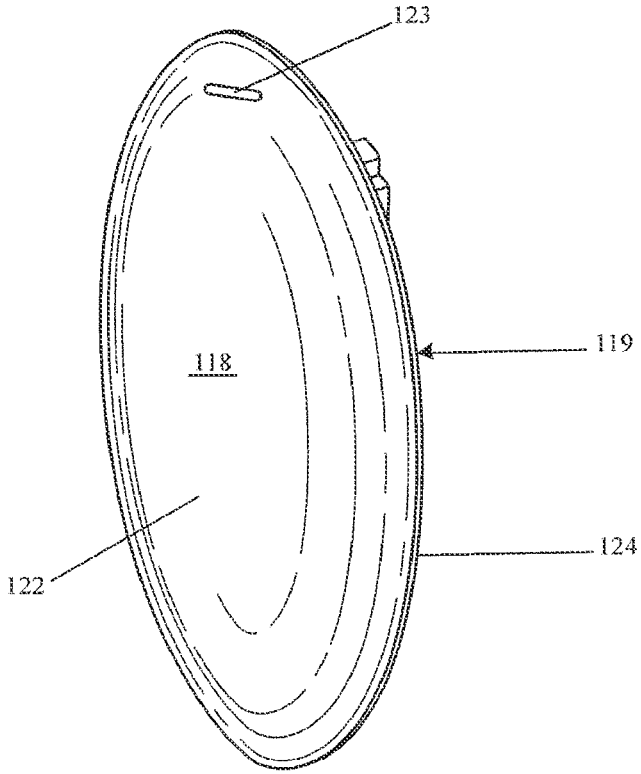
FIG. 9 is a front perspective view of a battery cap according to an embodiment.

Moving to FIG. 7, table assembly 150 is mounted by legs 152 to an internal element of the headphone shell (not shown), by way of example, in the instant embodiment, a battery box 154, which contains the headphone batteries. A PCB board 156 containing the circuitry and electronics for the operation of the headphone assembly may optionally be mounted intermediate the battery box and the table assembly; however, it may be located elsewhere within or external to the structure in accordance with space limitations and the overall configuration of the headphone shell design. A protective flow-free cover or cap 158 may also be mounted over the table assembly to protect the speaker and driver mechanism, as hereinabove described with respect to the supporting grid of the embodiment of FIG. 4. The protective cover 158 is illustrated in greater detail in FIG. 8 and includes a plate member 160 in which are formed a plurality of holes or apertures 162 to permit free flow of sound from the speaker to the user's inner ear canal.

Referring now to FIGS. 9 through 15, various embodiments of the battery cap 118 of FIG. 1 are shown in greater detail. The battery cap includes a body portion 119 adapted to be removably mounted over a battery compartment or box (element 154 in FIG. 7) typically formed in or secured to the earcup 110. While in the embodiment shown, the body portion is generally oval or elliptically-shaped, it is to be understood that the configuration is shown for purposes of illustration only, and that other shapes and configurations may be used without departing from the scope of the present invention. The body portion includes an outer surface 122 in which is formed a speaker aperture 123 and an inner surface 124 adapted to fit over the battery compartment 154 in the ear cup. In the embodiment shown, the inner and outer surfaces are generally curvilinear in shape to conform to the overall shape of the ear cup for aesthetic reasons The inner surface 124 of the battery cap 118 is illustrated in greater detail in FIGS. 10 and 11 and includes at least one reinforcing rib 127 formed integrally therewith or affixed thereto to stiffen the cap. In the embodiment shown, the cap also includes at least one upper lug 131 positioned on and secured to or formed integrally with an upper or first end portion 135 of the inner surface of the battery cap and at least one lower lug 133 positioned on and secured to or formed integrally with a lower or second end portion 139 of the inner surface of the battery cap.

Figure 10:
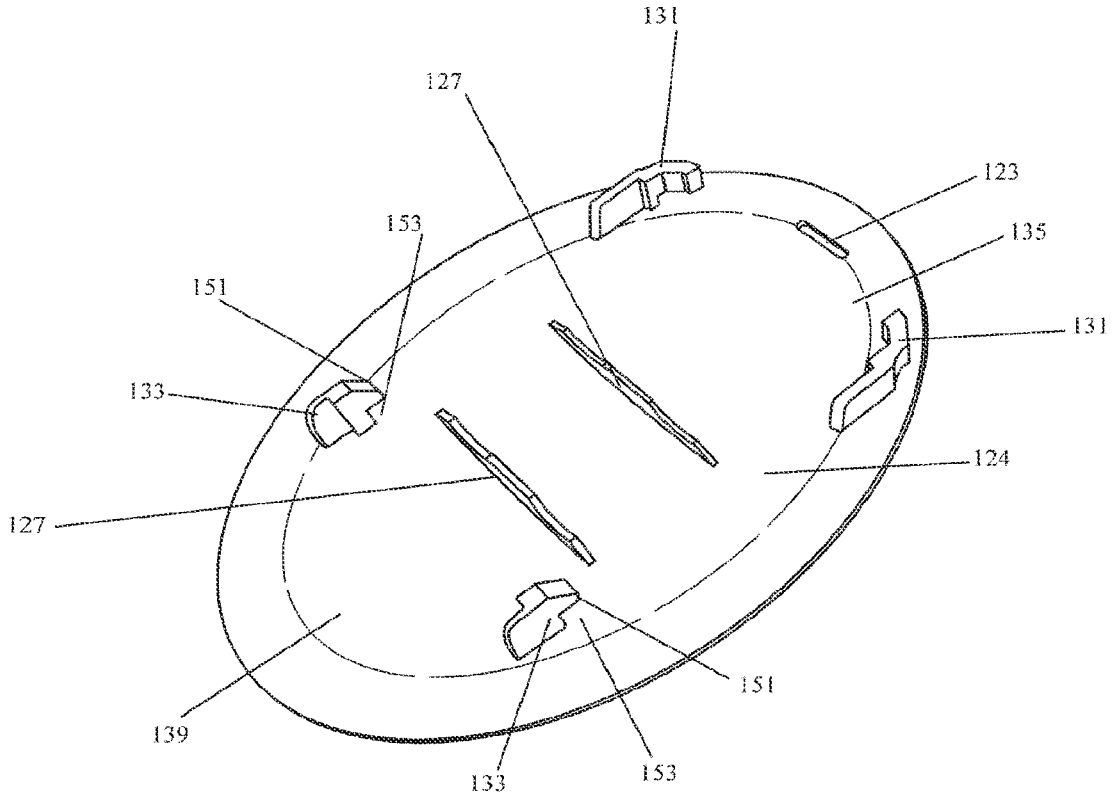
FIG. 10 is a rear perspective view of the battery cap of FIG. 9.
Figure 11:
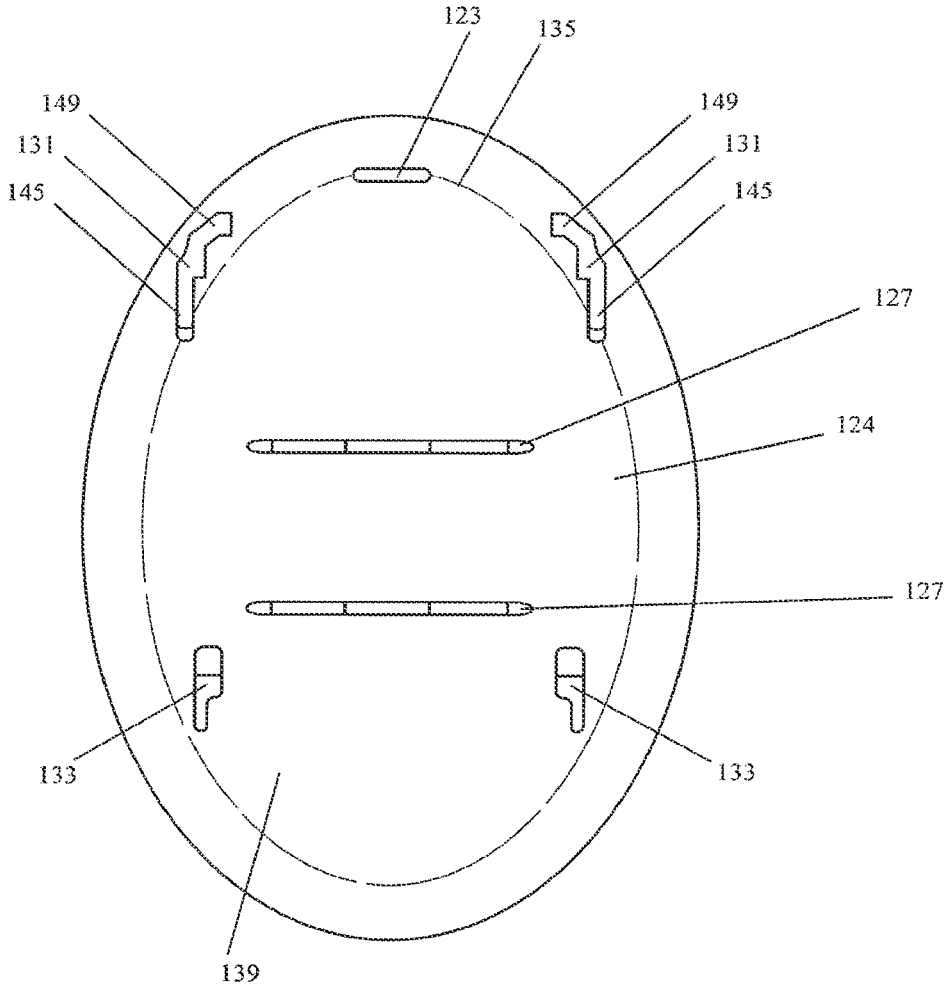
FIG. 11 is a rear plan view of the battery cap of FIGS. 9 and 10.
Figure 12:
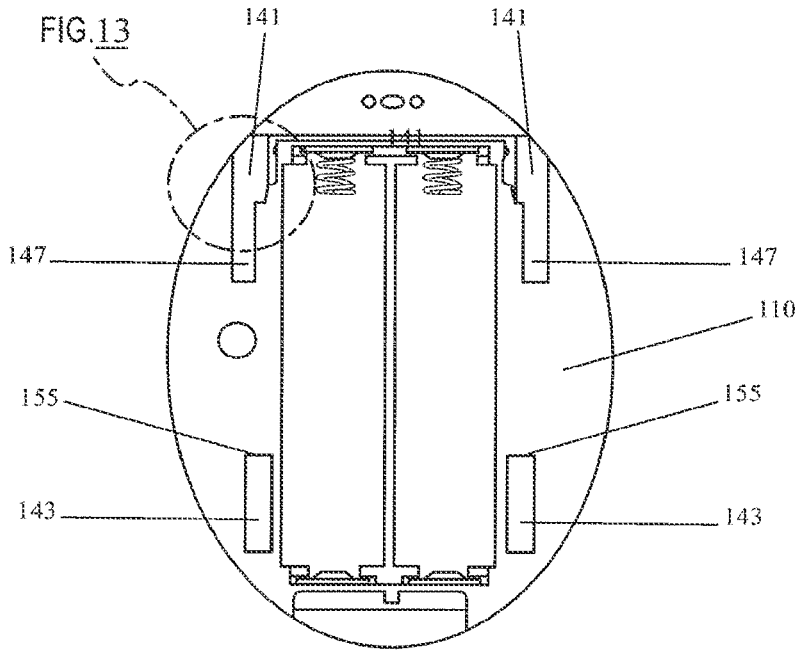
FIG. 12 is a plan view of a battery compartment according to an embodiment.
Figure 13:
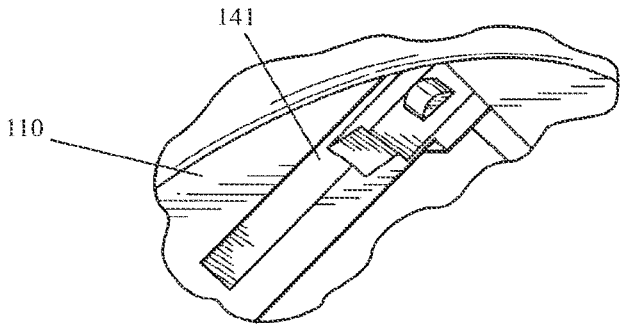
FIG. 13 is an enlarged partial sectional view of a portion of the battery compartment of FIG. 12.

Each of the upper and lower lugs are adapted to be removably received in a corresponding aperture 141, 143 respectively formed in the earcup shell 110, as shown in greater detail in FIGS. 12 and 13. Each of the upper lugs 131 includes an elongate body element 145 which is adapted to be received, aligned and retained in position by a corresponding elongate segment 147 of the apertures 141 and 143 respectively. The upper lugs each further include an angular end portion 149 which extends radially inwardly from the elongated body element and is adapted to provide an interference fit with the apertures 141 and 143 to hold the battery cap in position on the ear cup. In the embodiment of FIGS. 10 and 11, the angular end portion is shown to extend inwardly at an angle of approximately 45 degrees from the axis of the elongated body element. However, it is to be understood that the angle is not critical to the overall functioning of the lug and other angles may be used with equal effectiveness, depending upon the configuration of the ear cup and battery cap designs. By way of example, FIGS. 14 and 15 depict yet another embodiment of the instant invention wherein the angular end portions 149' are formed at substantially right angles to the elongated body elements 145'.

Figure 14:
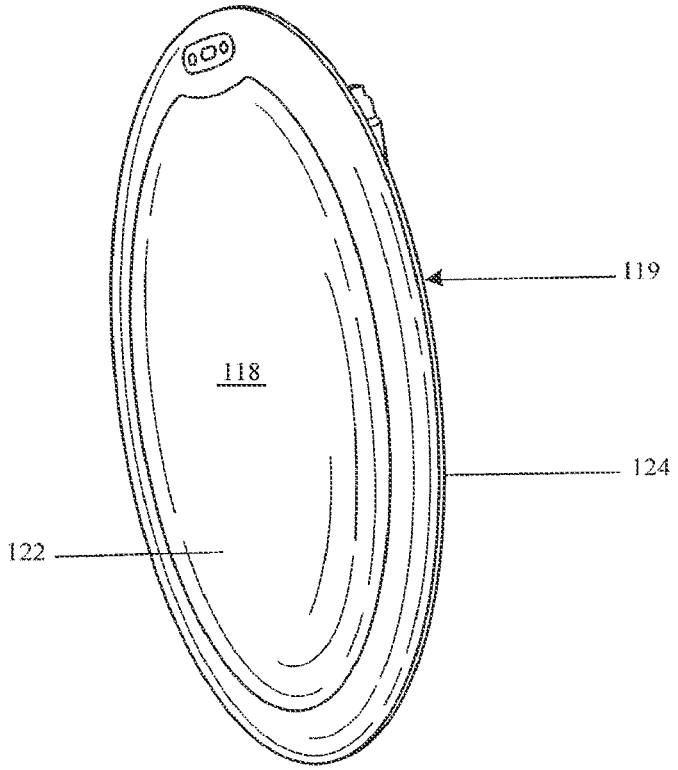
FIG. 14 is a front perspective view of a battery cap according to another embodiment.
Figure 15:
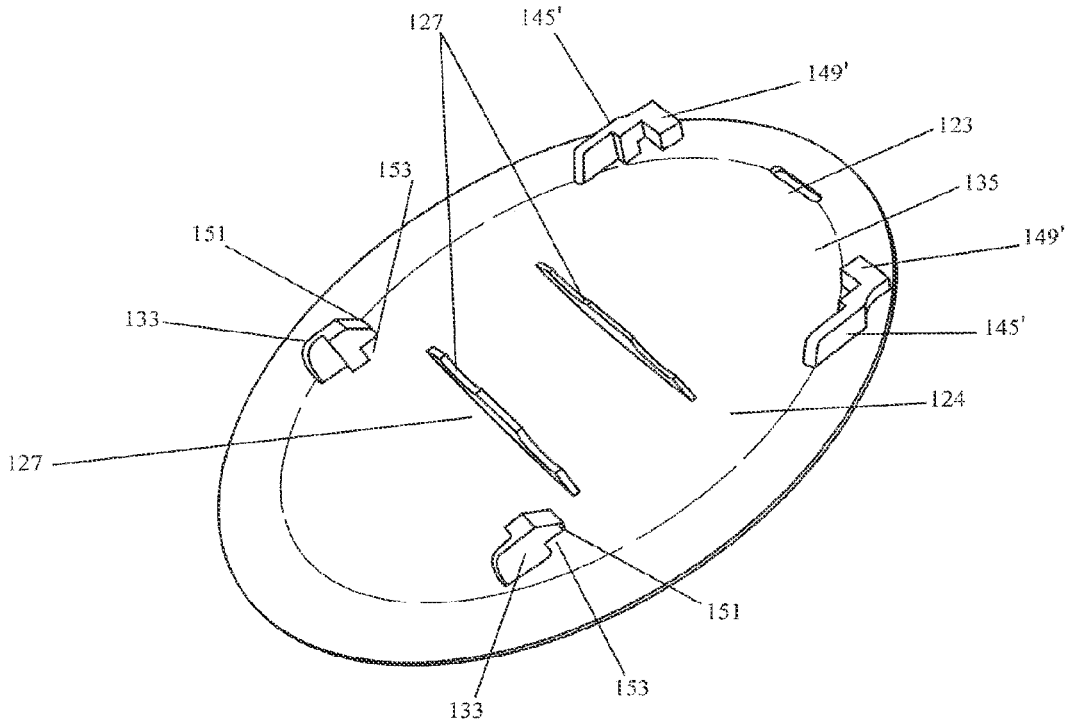
FIG. 15 is a rear perspective view of the battery cap of FIG. 14.
Figure 16:
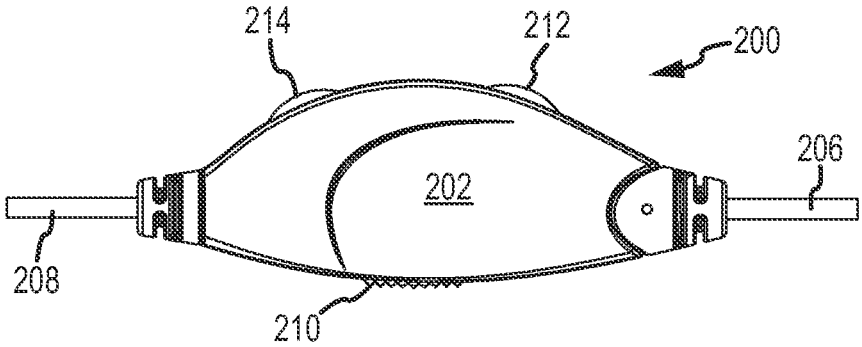
FIG. 16 is a side elevational view of a sound volume balance control in accordance with an embodiment.
Figure 17:
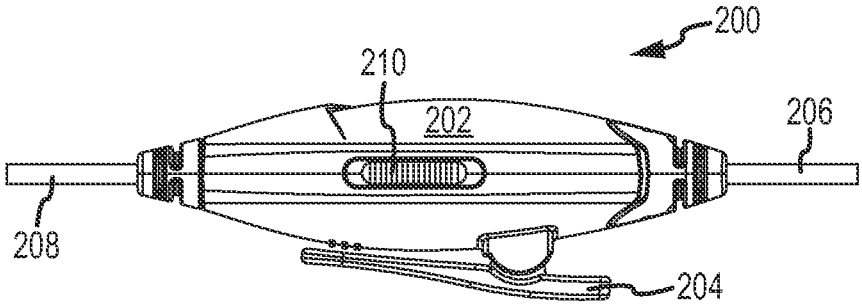
FIG. 17 is a top plan view of the sound volume balance control of FIG. 16.
Figure 18:
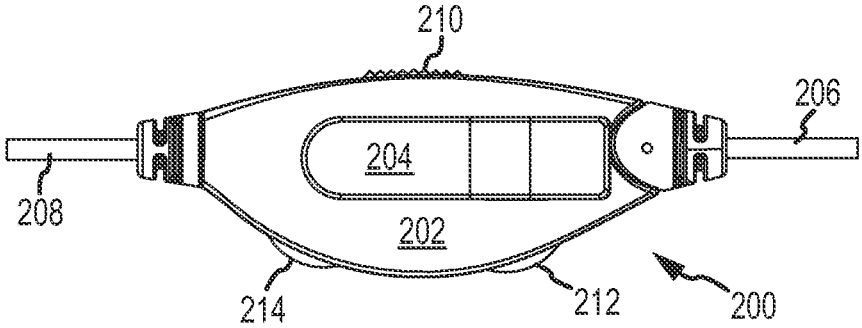
FIG. 18 is a rear elevational view of the sound volume balance control of FIGS. 16 and 17.
Figure 19:
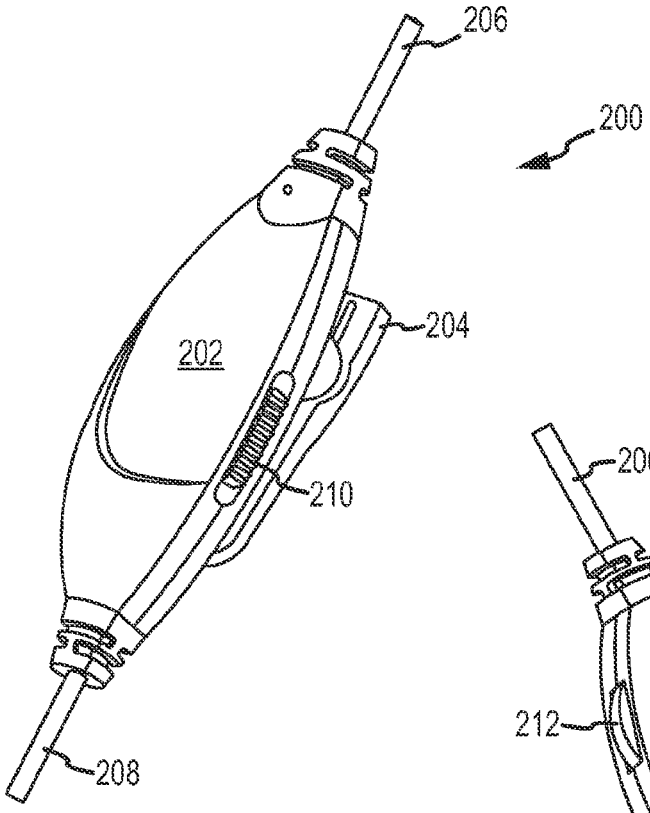
FIGS. 19 and 20 are front and rear perspective views of the sound volume balance control of FIGS. 16-18.
Figure 20:
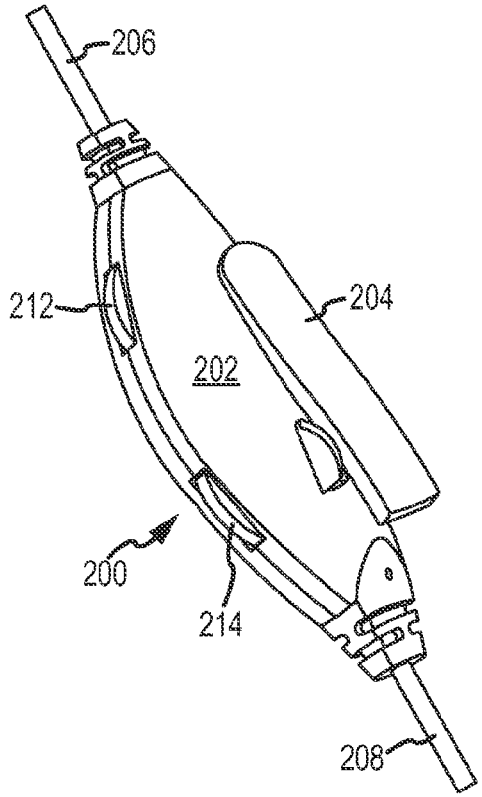

Referring now to FIGS. 10 and 14, each of the lower lugs 133 includes a tapered member 151 which extends generally laterally outwardly from the lug from the lower end 139 of the battery cap 118 in a direction toward the upper end 135 of the battery cap in a direction substantially parallel with the plane of the inner surface 124. Each of the tapered members 151 form a space 153 intermediate the inner surface 124 of the battery cap and the tapered member. Each of the spaces is structured and arranged to removably fit over an upper edge 155 of each of the apertures 143, thereby locking the battery cap in place on the ear cup during operation by a wearer. To remove or change out the batteries (not shown), a user may simply depress the lower portion 139 of the battery cap to disengage it and thereafter slide it off the ear cup. To replace the battery cap on the ear cup, the upper and lower lugs are simply positioned within their respective receiving apertures and the battery cap is pushed under slight pressure toward the upper portion of the ear cup to lock it in place.

Referring to FIGS. 16-20, means for selectively psychoacoustically calibrating, adjusting and balancing the sound volume in each earcup is shown generally at 200. For purposes of simplicity, the means 200 will be referred to herein and in the appended claims as either balancing means or balance control device. The balancing means is designed to permit a wearer of the headphone apparatus who has monaural hearing loss to selectively increase sound volume directed to an ear having hearing loss without increasing sound volume directed to an ear having no hearing loss, thereby avoiding potential damage to and resulting hearing loss in the ear having normal hearing.

The balance control device 200 includes a housing or body member 202 having a clip or fastener 204 affixed thereto to permit the wearer to attach the device to his or her belt or other clothing. The device is operatively connected to the headphone apparatus by cables or conductors 206, 208 extending from each end thereof. Control elements 210, 212 and 214 are adapted to turn the device on and off and to selectively calibrate, adjust and balance the sound volume directed to each headphone. In an embodiment, a calibration device (not shown) is incorporated into or operatively coupled to the balance control device and structured and arranged to provide clear sound tones in the sound transmission that are perfectly centered or balanced as intended by the composer of the original transmission. The headphone user then may reset the center point in response to the wearer's psychoacoustic perception of centered, balanced sound volume; and lock the balance control at the wearer's psychoacoustically perceived center, whereby all sounds subsequently delivered to the headphone apparatus will be calibrated to the balance of the original sound transmission.

Changes may be made to the above methods, systems, devices and structures without departing from the scope hereof. It should be noted that the matter contained in the above description and/or shown in the accompanying drawings should be interpreted as illustrative and not in a limiting sense. The following claim(s) are intended to cover all generic and specific features described herein as well as statements of the scope of the present invention, which, as a matter of language, might be said to fall therebetween.

What is claimed is:

1. A headphone apparatus comprising:

a pair of earphones, each earphone including an earcup, each earcup having an outer shell defining an internal chamber adapted to fit over a wearer's right and left outer ears respectively;

electronics, circuitry, microphones, at least one speaker including a diaphragm and associated driving members mounted in the internal chamber of each earphone for operation of the headphone and the transformation of electrical signals into acoustical signals for transmission to left and right inner ear canals of the wearer;

means for mounting a driver and driving member in the internal chamber of each earphone;

an adjustable headband adapted to fit a user's head and having a first and second end portion, each end portion including a yoke member secured thereto, each yoke member being structured and arranged to pivotally mount one of the earcups respectively;

a battery compartment formed in the outer shell of at least one of the earcups;

a battery cap detachably secured to the outer shell for containing at least one battery in the battery compartment; and means for detachably securing the battery cap to the outer shell, wherein the driver mounting means comprises an arm having first and second opposite end portions secured at the first end portion to a frame adapted to be mounted inside the internal chamber of each earphone, the frame including a generally circumferentially-shaped outer annular portion adapted to be fitted into the earcup of each earphone, an inner ring element connected to the arm at the second end portion and to the driver and driving member, and a plurality of arm members disposed axially about the ring element and having first and second end portions, a first end portion being connected to the ring element, and a second end portion being connected to the frame.

2. The headphone of claim 1 wherein the arm members define a plurality of spaces, the spaces being structured and arranged to permit a free-flow of acoustic energy from an area in the internal chamber located behind the diaphragm to a portion of the chamber positioned between the diaphragm of each earphone and a corresponding outer ear.

3. The headphone of claim 1 wherein the arm members comprise wire spokes.

4. The headphone of claim 3 further including a supporting framework structured and arranged to provide structural support to the wire spokes.

5. The headphone of claim 1 wherein the driver mounting means comprises a maze structure having a plurality of irregularly shaped, spaced apart slots structured and arranged to help direct air flow and acoustic energy as it passes from an area in the internal chamber located behind the diaphragm to a portion of the chamber positioned between the diaphragm of each earphone and a corresponding outer ear.

6. The headphone of claim 1 wherein the driver mounting means comprises a table assembly mounted in the internal chamber of the earcup of each earphone.

7. The headphone of claim 6 including a printed circuit board containing the circuitry and electronics for the operation of the headphone apparatus mounted intermediate the battery compartment and the table assembly.

8. The headphone of claim 1 wherein the battery cap includes a body portion adapted to be removably mounted over the battery compartment, the body portion including an outer surface having a speaker aperture formed therein and an inner surface adapted to fit over the battery compartment.

9. The headphone of claim 8 wherein the battery cap includes at least one reinforcing rib affixed thereto.

10. The headphone of claim 8 further including at least one upper lug positioned on a first end portion of the inner surface and at least one lower lug positioned on a second end portion of the inner surface of the battery cap, each of the at least one upper and lower lugs being adapted to be removably received in a corresponding aperture formed in the earcup of each earphone.

* * * * *